US010806205B2

(12) United States Patent
Ichigaya

(10) Patent No.: US 10,806,205 B2
(45) Date of Patent: Oct. 20, 2020

(54) VENTILATING DEVICE IN HELMET

(71) Applicant: SFT Laboratory Co., Ltd., Tokyo (JP)

(72) Inventor: Hiroshi Ichigaya, Tokyo (JP)

(73) Assignee: SFT Laboratory Co., Ltd., Tokyo (JP)

( * ) Notice: Subject to any disclaimer, the term of this patent is extended or adjusted under 35 U.S.C. 154(b) by 182 days.

(21) Appl. No.: 14/905,534

(22) PCT Filed: May 15, 2014

(86) PCT No.: PCT/JP2014/062948
§ 371 (c)(1),
(2) Date: Jan. 15, 2016

(87) PCT Pub. No.: WO2015/008529
PCT Pub. Date: Jan. 22, 2015

(65) Prior Publication Data

US 2016/0157547 A1 Jun. 9, 2016

(30) Foreign Application Priority Data

Jul. 18, 2013 (JP) ..... 2013-149280

(51) Int. Cl.
*A42B 3/28* (2006.01)

(52) U.S. Cl.
CPC ..... *A42B 3/286* (2013.01)

(58) Field of Classification Search
CPC .. A42C 5/04; A42B 3/28; A42B 3/286; A42B 1/067; A42B 1/008; A41D 13/0025;
(Continued)

(56) References Cited

U.S. PATENT DOCUMENTS 3,096,702 A * 7/1963 Malone, Sr. ..... F04D 25/084 2/81
3,813,696 A * 6/1974 Yeager ..... A42B 3/286 2/171.3

(Continued)

FOREIGN PATENT DOCUMENTS

CN 203676252 U 7/2014
JP 2004-27418 A 1/2004

(Continued)

OTHER PUBLICATIONS

Lanyard Store, "Clear Plastic Lanyards," Archived on Jan 22, 2011 via the Wayback Machine (https://web.archive.org/web/20110122074656/https://www.lanyardstore.com/plastic-lanyards.html).*

(Continued)

*Primary Examiner* — Jameson D Collier
*Assistant Examiner* — Jocelyn Bravo
(74) *Attorney, Agent, or Firm* — Crowell & Moring LLP

(57) ABSTRACT

A ventilating device is disclosed. The device includes a bag-shaped body with an upper part open using a first guiding sheet and a second guiding sheet. An attachment device attaches the bag-shaped body to the helmet. An air blower takes in outside air into the bag-shaped body and sends it out to a side of an open portion of the bag-shaped body. The second guiding sheet is located on a side of a human body and the first guiding sheet is located on an outer side, the air taken into the bag-shaped body is led to the open portion of the bag-shaped body along the first guiding sheet and the second guiding sheet and introduced into the helmet through an air inlet formed between an inner edge of the helmet located close to the open portion and a head of a user to ventilate the inside of the helmet.

10 Claims, 8 Drawing Sheets

(58) Field of Classification Search
CPC ..... A41D 13/09043; A62B 17/005; A62B 18/0045; A62B 18/003; A62B 18/006
USPC ..... 417/234
See application file for complete search history.

(56) References Cited

U.S. PATENT DOCUMENTS

| | | | | | |
|---|---|---|---|---|---|
| 4,141,083 | A * | 2/1979 | Waters | A42B 3/286 | 2/171.3 |
| 4,180,868 | A * | 1/1980 | Snow | A42B 3/105 | 2/172 |
| 4,893,356 | A * | 1/1990 | Waters | A42B 1/008 | 2/171.3 |
| RE33,286 | E * | 8/1990 | Waters | A42C 5/04 | 2/171.3 |
| 5,046,329 | A * | 9/1991 | Travis, III | A61F 7/0085 | 62/259.3 |
| 5,153,943 | A * | 10/1992 | Clement | A42B 1/067 | 2/172 |
| 5,871,132 | A * | 2/1999 | Hargreaves | A41D 13/0537 | 2/46 |
| 5,926,854 | A * | 7/1999 | Grilliot | A61F 9/025 | 2/422 |
| 6,666,647 | B1 * | 12/2003 | Trask | F04D 25/08 | 224/258 |
| 6,857,134 | B1 | 2/2005 | Cowell | | |
| 7,114,194 | B2 * | 10/2006 | English | A42B 3/286 | 2/171.3 |
| 7,310,829 | B1 * | 12/2007 | Engel-Wilson | A42B 1/067 | 2/175.6 |
| D638,205 | S * | 5/2011 | Castillo | D2/866 | |
| 2002/0035745 | A1 | 3/2002 | Spell | | |
| 2005/0060792 | A1 * | 3/2005 | Desai | A41B 9/00 | 2/403 |
| 2006/0048776 | A1 * | 3/2006 | Cunningham | A42B 3/286 | 128/201.22 |
| 2013/0160195 | A1 * | 6/2013 | Clement | A61F 9/028 | 2/437 |

FOREIGN PATENT DOCUMENTS

| | | | |
|---|---|---|---|
| JP | 2012-180606 | A | 9/2012 |
| JP | 3186431 | U | 10/2013 |
| WO | WO 2006/090677 | A1 | 8/2006 |
| WO | WO 2015/162695 | A1 | 10/2015 |

OTHER PUBLICATIONS

PCT/JP2014/062948, International Search Report dated Jun. 17, 2014 (One (1) page).
PCT/JP2014/062948, PCT/IB/338 dated Jan. 28, 2016 (One (1) page).
PCT/JP2014/062948, International Preliminary Report on Patentability (PCT/IB/373) dated Jan. 19, 2016, enclosing English Translation of Written Opinion of the International Searching Authority (PCT/ISA/237) Five (5) pages).
Japanese Decision to Grant a Patent issued in Japanese counterpart application No. 2015-527203 dated Sep. 26, 2016 (Three (3) pages).
European Search Report issued in European counterpart application No. 14825776.9-1731 /3023020 PCT/JP2014062948 dated Jan. 30, 2017 (Six (6) pages).
Chinese Office Action issued in Chinese counterpart application No. 201480040779.8 dated Jan. 3, 2018 (Five (5) pages).
Indian Examination Report issued in Indian counterpart application No. 201647000761 dated Feb. 7, 2019 (Eight (8) pages).

* cited by examiner

FIG. 7(a)
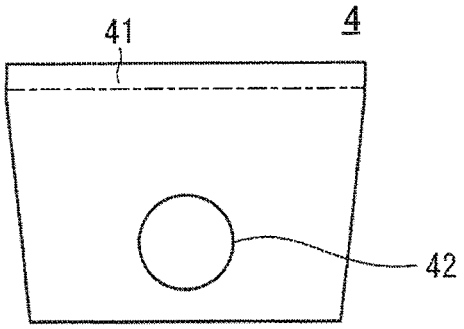
FIG. 7(b)
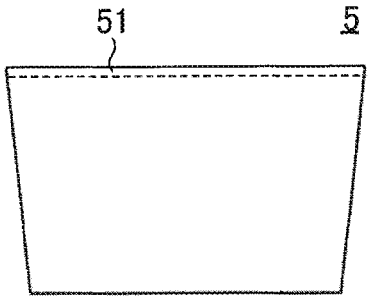
FIG. 7(c)
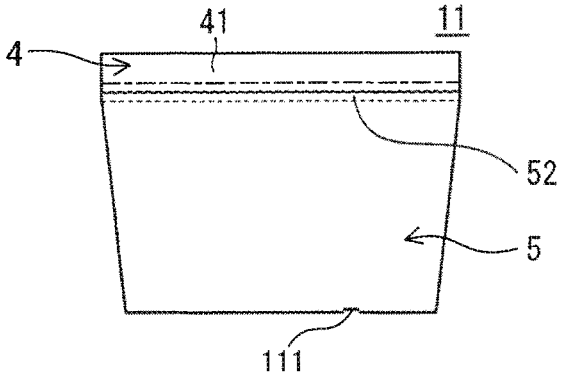
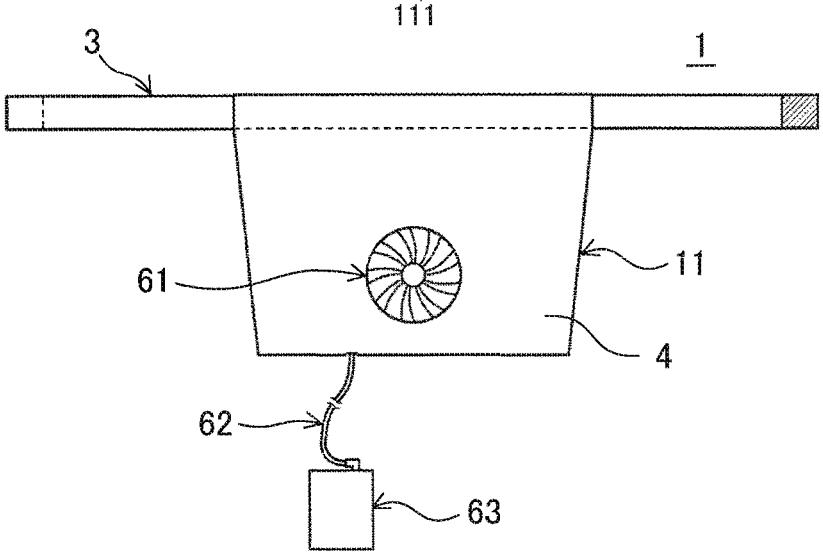
FIG. 7(d)

FIG. 8(a)
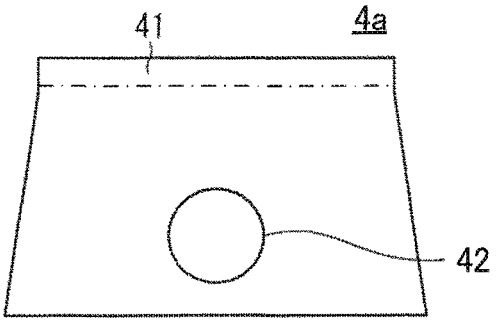
FIG. 8(b)
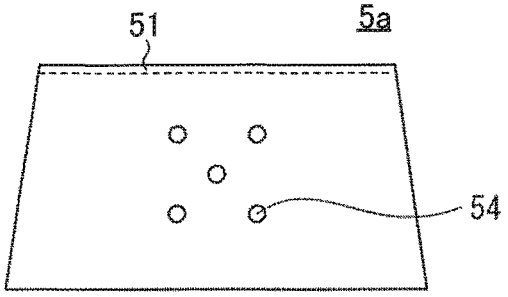
FIG. 8(c)
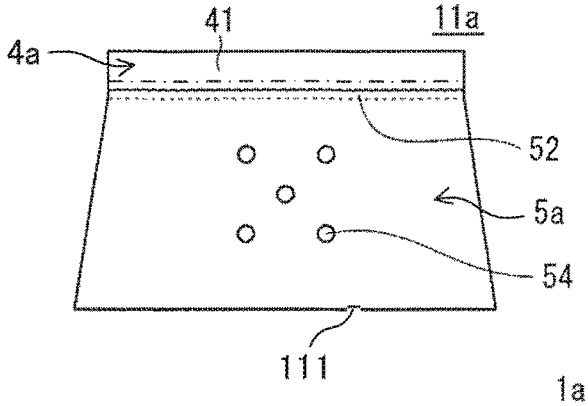
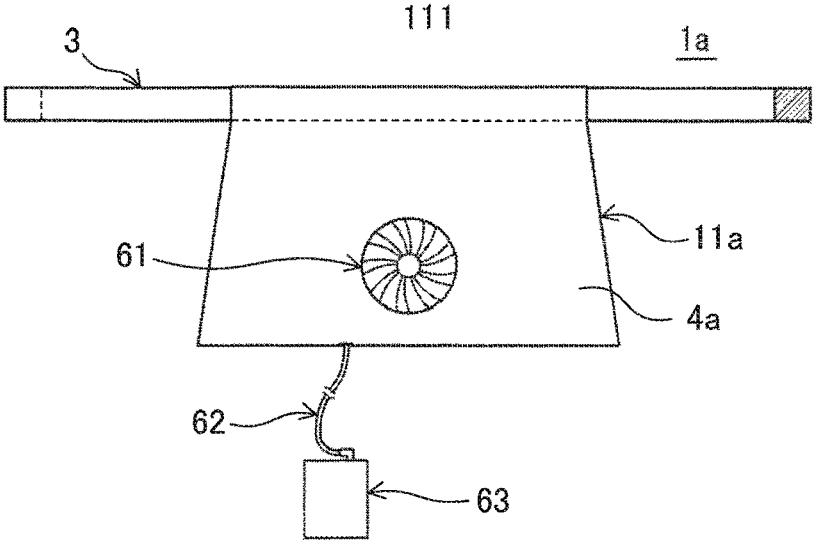
FIG. 8(d)

VENTILATING DEVICE IN HELMET

TECHNICAL FIELD

The present invention relates to a ventilating device in a helmet for ventilating an inside of the helmet by sending air into the helmet when the helmet is worn.

BACKGROUND ART

Recently, a device for adding an air blowing function to an existing work helmet that satisfies safety standard has been put into practice (see Patent Literature 1, for example). This type of device is constituted such that an air blower is attached to an edge on an outer side of a helmet and outside air taken in by the air blower is sent into the helmet by an inlet tube (a tubular duct, for example).

CITATION LIST

Patent Literature

Patent Literature 1: Japanese Unexamined Patent Application Publication No. 2012-180606

SUMMARY OF INVENTION

Technical Problem

However, the aforementioned device for adding the air blowing function to the work helmet has the following serious problems in performance. First, since the device is directly attached to the helmet, the one having a large air blower cannot be used in view of weight. Thus, a large quantity of air cannot be sent into the helmet, and sweatiness of the head part cannot be sufficiently solved. Secondly, since the inlet tube is provided in a gap between the helmet and the head part, a cross-sectional area of the inlet tube cannot be made large. Thus, in order to realize ventilation that can sufficiently solve sweatiness of the head part, an air velocity of the air sent into the helmet needs to be extremely large. However, since power consumption is in proportion with a square of the air velocity, if the air velocity is increased, a battery is consumed soon.

Incidentally, a work helmet with an air blowing function in which the air blowing function is incorporated inside the helmet in advance has also been put into practice. In this work helmet with the air blowing function, a problem similar to that of the aforementioned device occurs in view of an air amount and power consumption.

Efficient introduction of a required amount of air into the helmet substantially depends on an area of an air inlet for introducing air between the helmet and the head part. If the area of the air inlet is sufficiently large, the following great merits can be obtained. That is, first, even if the air velocity is small, a large quantity of air can be sent into the helmet. Secondly, a propeller fan with a low air blowing pressure can be used. As a result, power consumption decreases, and a noise of the air blowing means also decreases.

The present invention is accomplished on the basis of the aforementioned circumstances and has an object to provide a ventilating device in a helmet that can sufficiently solve sweatiness of the head part of a user when the user wears the helmet.

Solution to Problem

In order to achieve the aforementioned object, the present invention is a ventilating device in a helmet used by being attached to the helmet, including a bag-shaped body formed having a shape of a bag with an upper part open using a first guiding sheet and a second guiding sheet, attaching means provided on an upper end portion of the first guiding sheet and for attaching the bag-shaped body to the helmet, air blowing means attached to the bag-shaped body and for taking in outside air into the bag-shaped body and sending it out to a side of an open portion of the bag-shaped body along the first guiding sheet and the second guiding sheet, and power supply means for driving the air blowing means, wherein the bag-shaped body is attached to the helmet by using the attaching means so that the second guiding sheet is located on a side of a human body and the first guiding sheet is located on an outer side, the air taken into the bag-shaped body by the air blowing means is led to the open portion of the bag-shaped body along the first guiding sheet and the second guiding sheet and introduced into the helmet through an air inlet formed between an inner edge of the helmet located close to the open portion and the head part of a user so that the inside of the helmet is ventilated.

In the ventilating device in a helmet according to the present invention, by including the bag-shaped body with the upper part open, the attaching means for attaching the bag-shaped body to the helmet, and the air blowing means for taking in the outside air into the bag-shaped body and sending it out to the side of the open portion of the bag-shaped body, the air having been taken into the bag-shaped body by the air blowing means can be led to the open portion of the bag-shaped body and can be efficiently introduced into the helmet through the air inlet formed between the inner edge of the helmet located close to the open portion and the head part of the user, and thus, the inside of the helmet can be ventilated, and sweatiness of the head part of the user can be sufficiently solved.

Moreover, in the ventilating device in a helmet according to the present invention, the attaching means preferably has a belt arranged substantially in parallel with an upper end in the upper end portion of the first guiding sheet and two mutually attaching means provided on both end portions of the belt. In this case, after the belt is wound along a flange of the helmet around its side periphery portion, by mutually attaching the two mutually attaching means, the bag-shaped body can be attached to the helmet easily and securely.

Moreover, in the ventilating device in a helmet according to the present invention, an expandable expansion/contraction portion is formed on an upper end portion of the second guiding sheet, and when the helmet to which the ventilating device in a helmet is attached is worn, the expansion/contraction portion is preferably brought into close contact with the head part excluding both end portions of the expansion/contraction portion. As a result, since a large air inlet can be formed between the inner edge of the helmet located close to the expansion/contraction portion and the head part of the user, the air flowing through the bag-shaped body can be smoothly led into the helmet through the large air inlet.

Advantageous Effects of Invention

According to the ventilating device in a helmet according to the present invention, since the air having been taken into the bag-shaped body by the air blowing means can be led to the open portion of the bag-shaped body and can be efficiently introduced into the helmet through the air inlet formed between the inner edge of the helmet located close to the open portion and the head part of the user, the inside of the helmet can be ventilated, and sweatiness of the head part of the user can be sufficiently solved.

BRIEF DESCRIPTION OF DRAWINGS

FIG. 7(*a*) is a schematic front view of a first guiding sheet, FIG. 7(*b*) is a schematic front view of the second guiding sheet, FIG. 7(*c*) is a schematic rear view of a bag-shaped body, and FIG. 7(*d*) is a schematic front view of the completed ventilating device in a helmet.

FIG. 8(*a*) is a schematic front view of a first guiding sheet used in a ventilating device in a helmet that is a second embodiment of the present invention, FIG. 8(*b*) is a schematic front view of a second guiding sheet used in the ventilating device in a helmet, FIG. 8(*c*) is a schematic rear view of a bag-shaped body in the ventilating device in a helmet, and FIG. 8(*d*) is a schematic front view of the ventilating device in a helmet.

DESCRIPTION OF EMBODIMENTS

Embodiments for carrying out an invention according to the present application will be described below by referring to the attached drawings. A ventilating device in a helmet of the present invention is used by being attached to a helmet. Here, before the ventilating device in a helmet is described, first, a structure of a work helmet will be described.

Figure 1A:
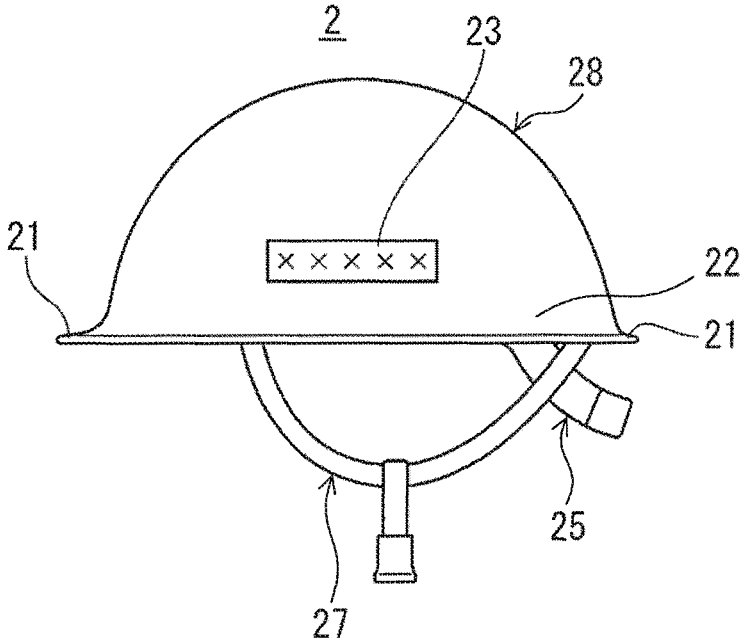
FIG. 1(*a*) is a schematic side view of a general work helmet and FIG. 1(*b*) is a schematic bottom view of the work helmet.
Figure 1B:
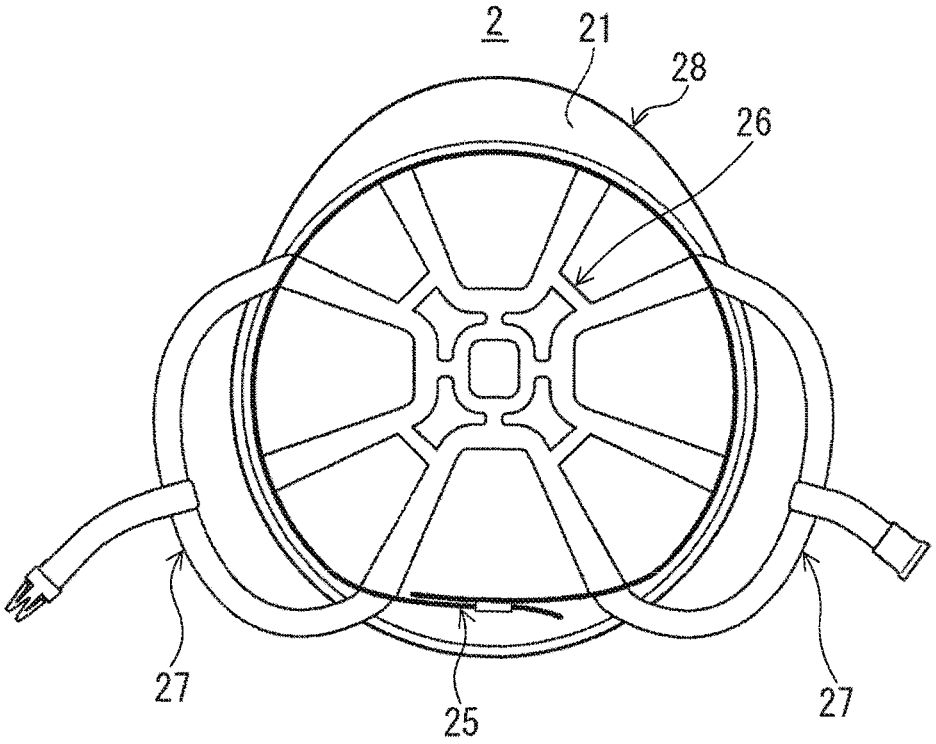

FIG. 1(*a*) is a schematic side view of a general work helmet and FIG. 1(*b*) is a schematic bottom view of the work helmet. A work helmet 2 has a hat body 28, a hammock 26, a head band 25, and a chin strap 27. There is a flange 21 on a front part of the hat body 28, and a small flange 21 for improving strength of the hat body 28 is formed on the entire periphery of the helmet 2 other than this flange on the front part. Inside the hat body 28, the hammock 26 for ensuring a certain interval between the hat body 28 and the head part is mounted. Moreover, by making adjustment by the head band 25 and the chin strap 27, the helmet 2 can be firmly fixed to the head part of a user. Incidentally, the head band 25 is constituted to be brought into contact with the back of the head part.

Notation information 23 such as the name of a person wearing the helmet 2, the name of a company, work contents and the like is usually noted down on an outer surface of the helmet 2, and the notation information 23 is important in safety work and the like.

First Embodiment

Subsequently, the ventilating device in a helmet that is a first embodiment of the present invention will be described.

Figure 2A:
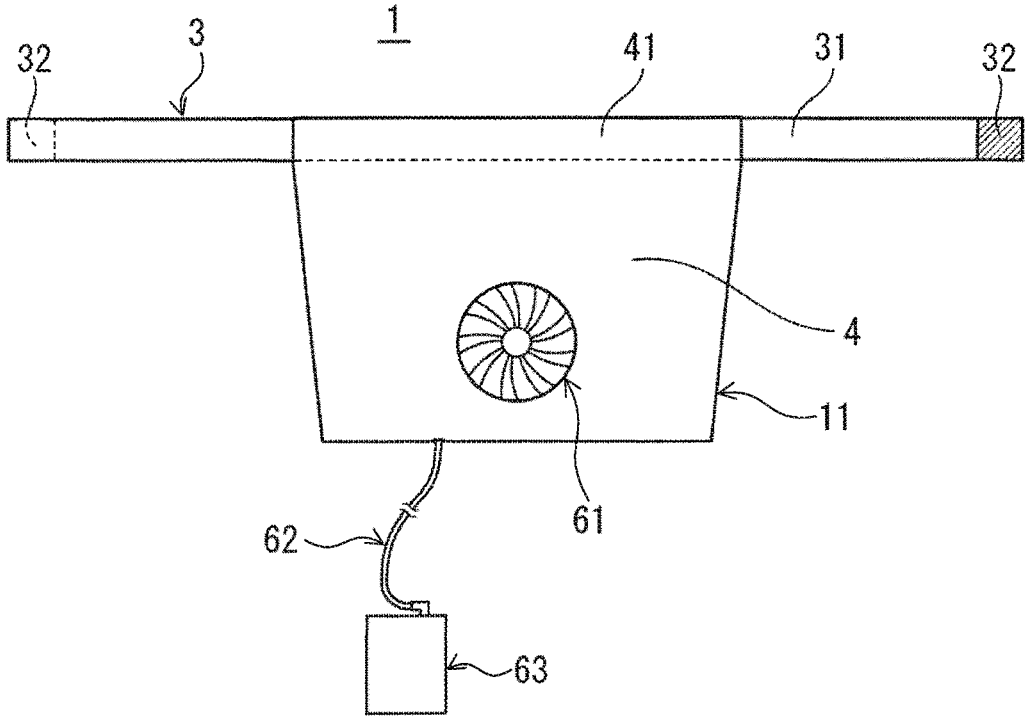
FIG. 2(*a*) is a schematic front view when a ventilating device in a helmet that is a first embodiment of the present invention is developed, and FIG. 2(*b*) is a schematic rear view of the ventilating device in a helmet.
Figure 2B:
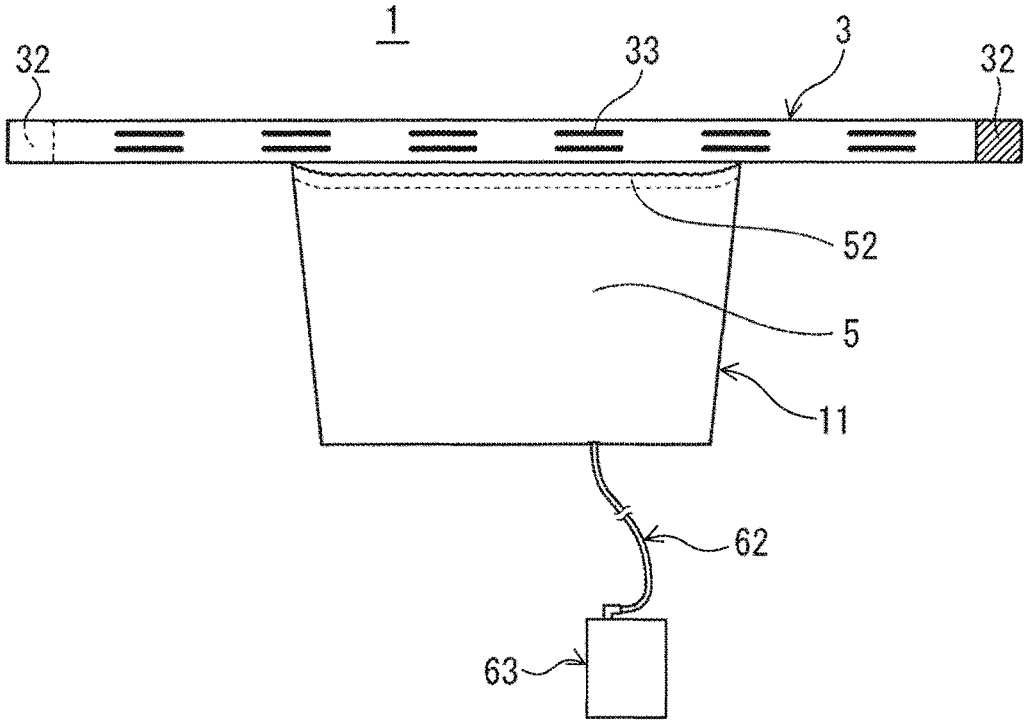

FIG. 2(*a*) is a schematic front view when the ventilating device in a helmet that is the first embodiment of the present invention is developed, and FIG. 2(*b*) is a schematic rear view of the ventilating device in a helmet. FIG. 2 illustrates a state in which an expansion/contraction portion in the ventilating device in a helmet is expanded to the maximum and developed.

The ventilating device in a helmet of the first embodiment is used by being attached to the helmet 2. As illustrated in FIG. 2, this ventilating device 1 in a helmet includes a bag-shaped body 11 made of fabric, an attaching belt (attaching means) 3, air blowing means 61, a power supply (power supply means) 63 for driving the air blowing means 61, and a cable 62 for electrically connecting the air blowing means 61 and the power supply 63.

The bag-shaped body 11 is formed having a shape of a bag with an upper part open by using two guiding sheets, that is, a first guiding sheet 4 and a second guiding sheet 5. The first guiding sheet 4 is formed having a substantially trapezoidal shape such that its lateral width gets smaller as it goes downward. On a lower part of this first guiding sheet 4, an opening portion 42 (see FIG. 7(*a*)) for mounting the air blowing means 61 is formed. On the other hand, the second guiding sheet 5 is formed having a shape obtained by cutting off an upper end portion of the first guiding sheet 4. This upper end portion of the second guiding sheet 5 is an expandable expansion/contraction portion 52. In the first embodiment, the expansion/contraction portion 52 is formed by incorporating a rubber strap (strap-shaped elastic member) in the upper end portion of the second guiding sheet 5. By overlapping the first guiding sheet 4 and the second guiding sheet 5 with each other and by sewing their lower end portions and both side end portions together, the bag-shaped body 11 is produced. Therefore, in an open portion of the bag-shaped body 11, the upper end of the first guiding sheet 4 protrudes upward farther than the upper end of the second guiding sheet 5.

The attaching belt 3 is for attaching the bag-shaped body 11 to the helmet 2 and is provided on a belt attaching portion 41 that is the upper end portion of the first guiding sheet 4. Specifically, in this embodiment, the attaching belt 3 has a belt (elastic belt) 31 having expandability and two planar fasteners (mutually attaching means) 32 and 32 provided on the both end portions of the belt 31. The belt 31 is sewn to the belt attaching portion 41 of the first guiding sheet 4, whereby the belt 31 is arranged substantially in parallel with the upper end in the belt attaching portion 41 of the first guiding sheet 4. As illustrated in FIG. 1, the general work helmet 2 has the flange 21. After the belt 31 is wound along the flange 21 of the helmet 2 around a side peripheral portion 22 of the helmet 2, by mutually attaching the two planar fasteners 32 and 32, the bag-shaped body 11 can be attached to the helmet 2 easily and securely. In the attaching belt 3, a slip stopper 33 is applied to a surface in contact with the helmet 2. Thus, dislocation of the attaching belt 3 from the side peripheral portion 22 of the helmet 2 during use of the ventilating device 1 in a helmet can be prevented.

The air blowing means 61 is attached to the opening portion 42 formed on the lower part of the first guiding sheet 4. This air blowing means 61 takes in outside air into the bag-shaped body 11 and sends it out to a side of the open portion of the bag-shaped body 11 along the first guiding sheet 4 and the second guiding sheet 5, that is, to a side of the upper part of the bag-shaped body 11. The air blowing means 61 used in this embodiment is similar to air blowing means used in an air-conditioning clothes and can be detachably attached to the opening portion 42. Specifically, a propeller fan with a low air blowing pressure is used as the air blowing means 61. A structure and an attaching method of such air blowing means are described in WO 2006/090677, for example.

Subsequently, a procedure for attaching the ventilating device 1 in a helmet of the first embodiment to the helmet 2 will be described.

Figure 3A:
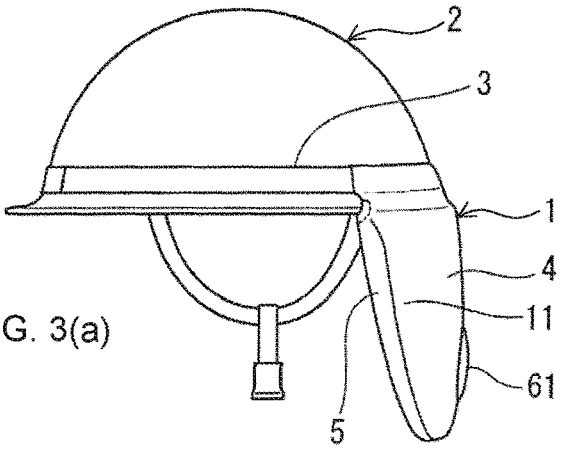
FIG. 3(*a*) is a schematic side view of the work helmet to which the ventilating device in a helmet of the first embodiment is attached, FIG. 3(*b*) is a schematic bottom view of the work helmet to which the ventilating device in a helmet is attached, and FIG. 3(*c*) is a schematic bottom view of the work helmet when a second guiding sheet is moved to an inner side of a head band.
Figure 3B:
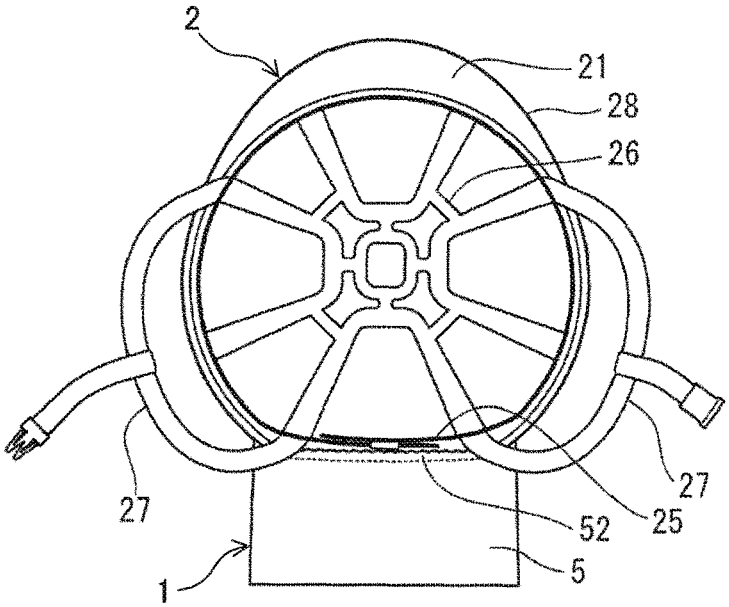
Figure 3C:
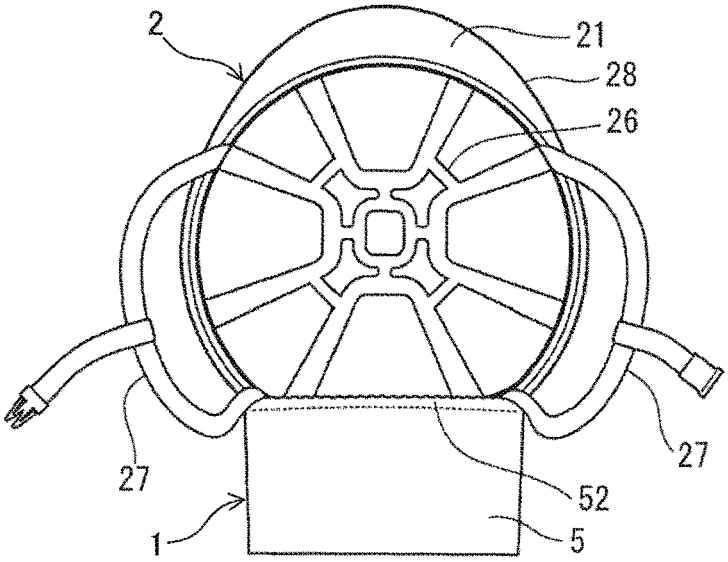

FIG. 3(*a*) is a schematic side view of the work helmet 2 to which the ventilating device 1 in a helmet of the first embodiment is attached, FIG. 3(*b*) is a schematic bottom view of the work helmet 2 to which the ventilating device 1 in a helmet is attached, and FIG. 3(*c*) is a schematic bottom view of the work helmet 2 when the second guiding sheet 5 is moved to an inner side of the head band 25.

When the ventilating device 1 in a helmet is to be attached to the helmet 2, a length of the head band 25 of the helmet 2 is adjusted in advance in accordance with a user. The user arranges the ventilating device 1 in a helmet so that the second guiding sheet 5 is located on a side of the human body (head) and the first guiding sheet 4 is located on an outer side and winds the belt 31 of the attaching belt 3 along the flange 21 of the helmet 2 around the side peripheral portion 22 of the helmet 2. After that, on the front side of the helmet 2, the planar fasteners 32 and 32 provided on the both end portions of the belt 31 are mutually attached. In this way, the bag-shaped body 11 is attached to the helmet 2 by using the attaching belt 3. In this state, the second guiding sheet 5 is located on the outer side of the head band 25 as illustrated in FIG. 3(*b*).

Subsequently, the expansion/contraction portion 52 that is the upper end of the second guiding sheet 4 is moved to the inner side of the head band 25 of the helmet 2. That is, the head band 25 is put in between the first guiding sheet 4 and the second guiding sheet 5. At this point, the length of the upper end portion of the bag-shaped body 11 should be a length of such a degree that the head band 25 provided on the helmet 2 can be put in between the first guiding sheet 4 and the second guiding sheet 5 when the ventilating device in a helmet is attached to the helmet 2. FIG. 3(*c*) illustrates a state after this expansion/contraction portion 52 is moved, and the head band 25 is hidden by the second guiding sheet 5. Here, a rubber strap is incorporated in the expansion/contraction portion 52, and since the expansion/contraction portion 52 literally expands/contracts, the expansion/contraction portion 52 can be moved from the outer side to the inner side of the head band 25 easily. Moreover, since the expansion/contraction portion 52 hardly sags even at its center part due to a tension of the rubber strap, the upper end of the second guiding sheet 5 is kept substantially linear from one of lower edges of the helmet 2 to the other lower edge. As described above, attachment of the ventilating device 1 in a helmet is extremely simple.

Figure 4A:
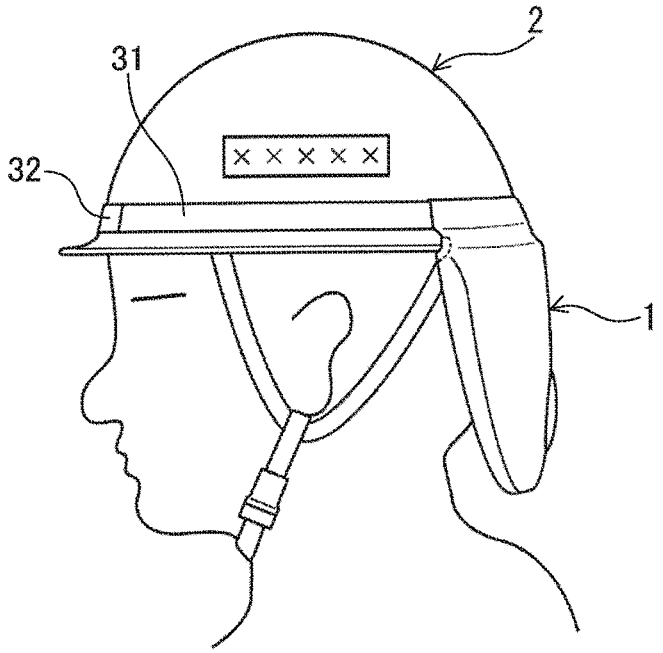
FIG. 4(*a*) is a schematic side view when the helmet to which the ventilating device in a helmet is attached is worn, and FIG. 4(*b*) is a schematic rear view when the helmet is worn.
Figure 4B:
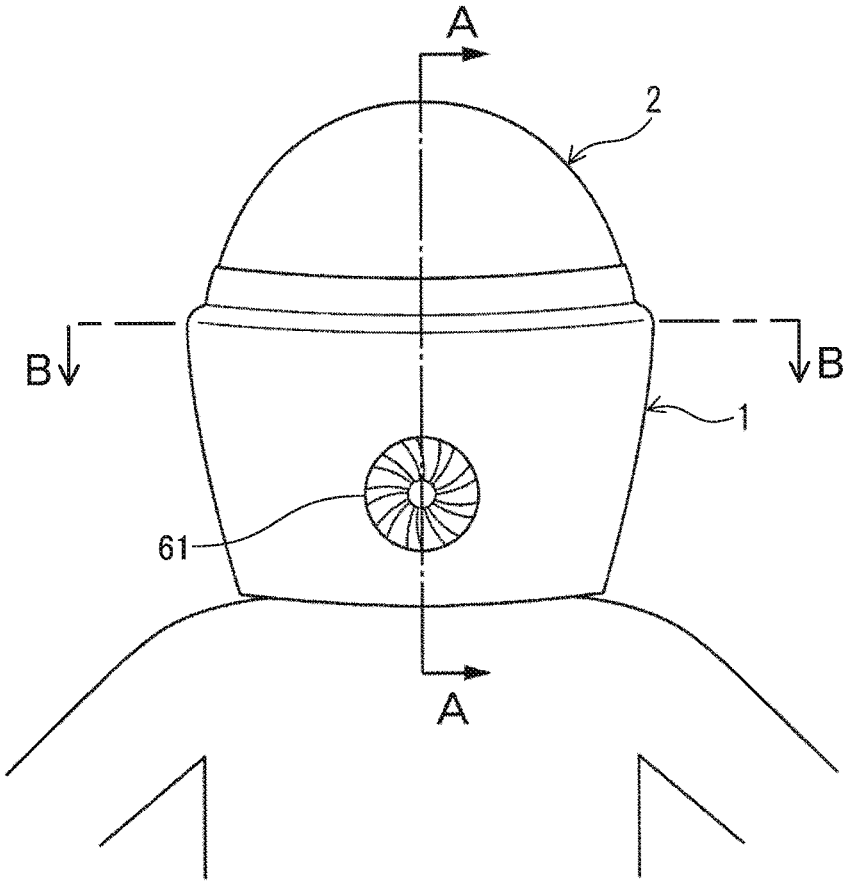
Figure 5A:
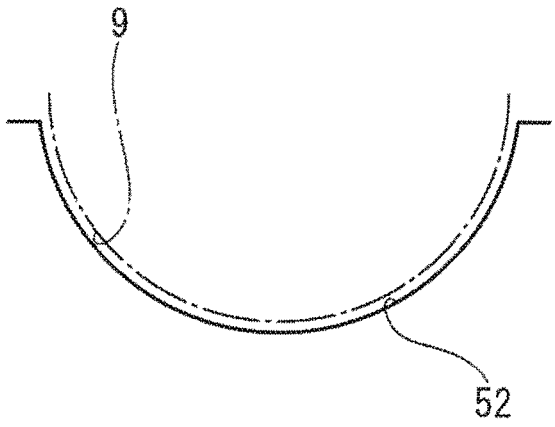
FIG. 5(*a*) is a view for explaining a relation between a head part and an expansion/contraction portion in the ventilating device in a helmet, and FIG. 5(*b*) is a view for explaining a relation between the head part and the second guiding sheet in the ventilating device in a helmet.
Figure 5B:
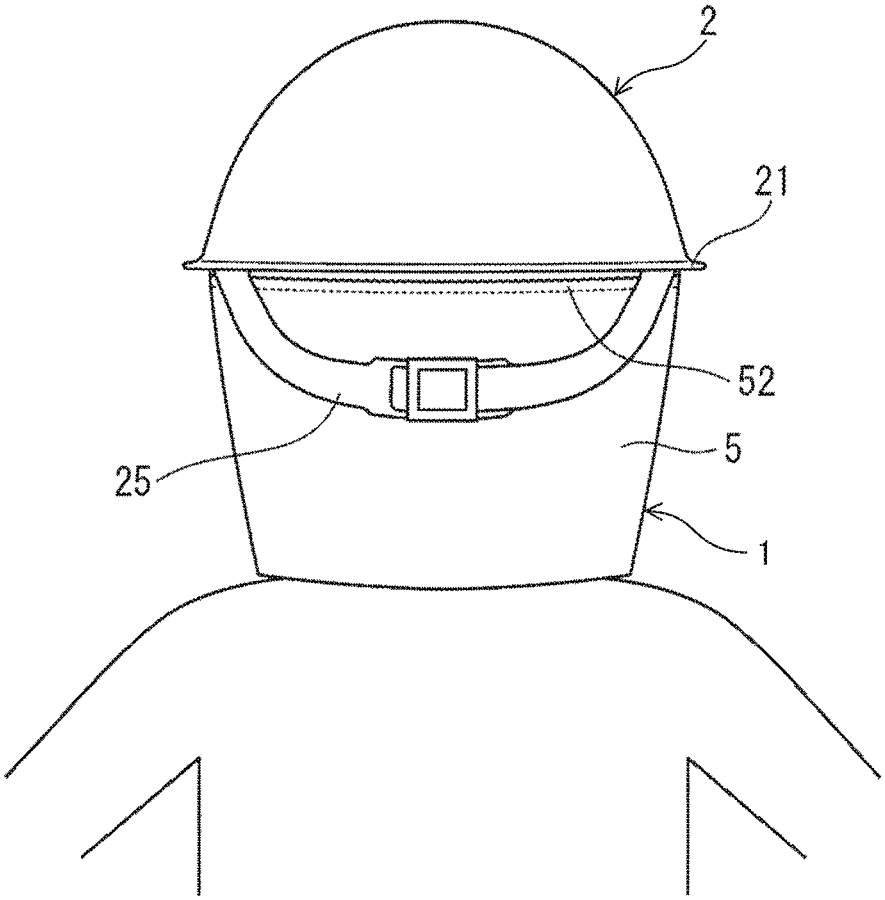

FIG. 4(*a*) is a schematic side view when the helmet 2 to which the ventilating device 1 in a helmet is attached is worn, and FIG. 4 (*b*) is a schematic rear view when the helmet 2 is worn. FIG. 5(*a*) is a view for explaining a relation between the head part and the expansion/contraction portion 52 in the ventilating device 2 in a helmet, and FIG. 5(*b*) is a view for explaining a relation between the head part and the second guiding sheet 5 in the ventilating device 2 in a helmet. Here, FIG. 5(*b*) illustrates a state in which the first guiding sheet 4 and the attaching belt 3 are omitted in FIG. 4 (*b*). When the ventilating device 1 in a helmet is attached to the work helmet 2 as described above, the user wears the work helmet 2 as illustrated in FIG. 4. When the user wears the work helmet 2 to which the ventilating device 1 in a helmet is attached, as illustrated in FIG. 5(*a*), the expansion/contraction portion 52 provided on the upper end portion of the second guiding sheet 5 enters a state of being pressed by the head part 9 of the user and expanded. Thus, the expansion/contraction portion 52 is pressed onto the rounded head part 9. Specifically, most of the expansion/contraction portion 52 excluding the both ends thereof is brought into close contact with the head part 9. That is, when the helmet 2 to which the ventilating device 1 in a helmet is attached is worn, the expansion/contraction portion 52 that is the upper end portion of the second guiding sheet 5 is brought into close contact with the head part 9 excluding the both end portions thereof at a height of the lower edge of the helmet 2 as a result. Moreover, as illustrated in FIG. 5(*b*), the substantial center part of the second guiding sheet 5 is pressed from an outer side thereof onto the head part 9 by the head band 25.

Subsequently, a flow of the air in the ventilating device 1 in a helmet of the first embodiment will be described.

Figure 6A:
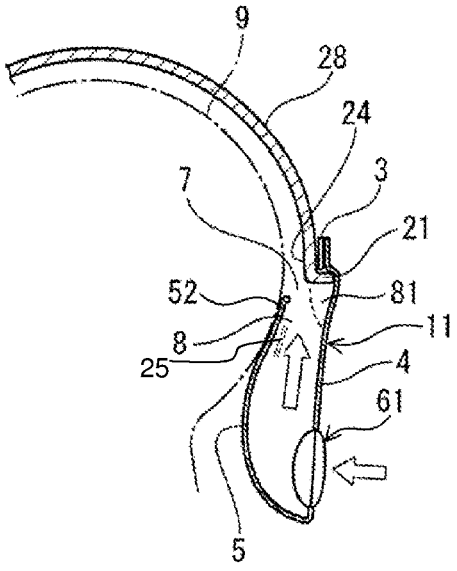
FIG. 6(*a*) is a schematic cross-sectional view of the ventilating device in a helmet of the first embodiment viewed in an A-A arrow direction, FIG. 6(*b*) is a schematic partially enlarged cross-sectional view of the ventilating device in a helmet in FIG. 6(*a*), and FIG. 6(*c*) is a schematic partially enlarged cross-sectional view of the ventilating device in a helmet of the first embodiment viewed in a B-B arrow direction.
Figure 6B:
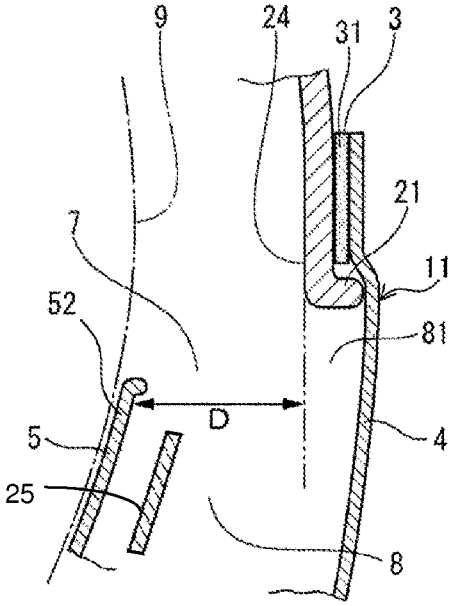
Figure 6C:
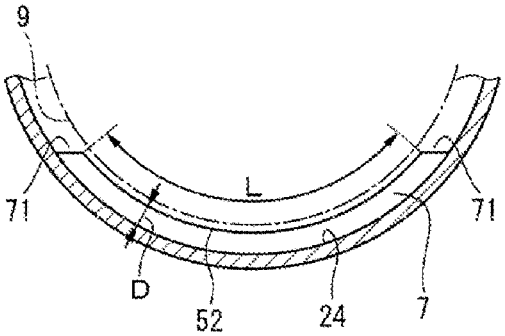

FIG. 6(*a*) is a schematic cross-sectional view of the ventilating device 1 in a helmet of the first embodiment viewed in an A-A arrow direction, FIG. 6(*b*) is a schematic partially enlarged cross-sectional view of the ventilating device 1 in a helmet in FIG. 6(*a*), and FIG. 6(*c*) is a schematic partially enlarged cross-sectional view of the ventilating device 1 in a helmet of the first embodiment viewed in a B-B arrow direction.

When the air blowing means 61 is operated, as illustrated in FIG. 6(*a*), a large quantity of air is taken into the bag-shaped body 11 from the air blowing means 61. Then, by a pressure of this taken-in air, the second guiding sheet 5 to which no special load is applied other than weight of the cloth itself expands easily toward the back of the neck, and an air inlet path that is a space surrounded by the first guiding sheet 4 and the second guiding sheet 5 is formed in the bag-shaped body 11. The air taken into the bag-shaped body 11 by the air blowing means 61 flows upward along the air inlet path.

Moreover, as described above, when the helmet 2 to which the ventilating device 1 in a helmet is attached is worn, the expansion/contraction portion 52 is brought into close contact with the head part 9 excluding the both end portions thereof and thus, a large air inlet 7 can be formed between the inner edge of the helmet 2 located close to the expansion/contraction portion 52 and the head part 9 of the user. Specifically, as illustrated in FIG. 6(*b*), the air inlet 7 having a large area is formed between the expansion/contraction portion 52 of the second guiding sheet 5 in contact with the head part 9 and the inner edge 24 of the helmet 2 or a virtual extension line along that. Thus, the air going upward along the air inlet path is introduced into the helmet 2 through the air inlet 7. Since the first guiding sheet 4 is in contact with the flange 21 of the helmet 2, an air reservoir 81 without any air flow is generated immediately below the flange 21, and the air going upward along the first guiding sheet 4 is smoothly introduced into the helmet 2 along the air reservoir 81 as a result. In this way, between the helmet 2 and the head part 9, a series of surfaces consisting of inner surfaces of the first guiding sheet 4, the air reservoir 81, and the hat body 28, and a series of surfaces consisting of surfaces of the second guiding sheet 5, its expansion/contraction portion 52, and the head part 9 are formed, whereby a continuous air flow passage 8 composed of these two series of surfaces is formed. When a large quantity of external air flows through the continuous air flow passage 8, the air in the helmet 2 can be ventilated and also, sweats from the head part can be evaporated, and the head part can be cooled by the vaporization heat. Incidentally, in this embodiment, since the head band 25 of the helmet 2 is put in between the first guiding sheet 4 and the second guiding sheet 5, the substantial center part of the second guiding sheet 5 can be pressed by the head band 25 to the head part 9 from the outer side and thus, a space through which the air flows in the bag-shaped body 1, that is, the air flow passage 8 can be ensured easily.

Since the head part 9 is rounded, the expansion/contraction portion 52 is brought into contact with the head part 9 excluding the both end portions thereof, there is no spot where air leaks in the air flow passage 8 excluding the both end portions (air inlet end portions 71) of the expansion/contraction portion 52 not in contact with the head part 9, and most of the external air having been taken in by the air blowing means 61 is introduced between the helmet 2 and the head part 9. Moreover, since the area of the air inlet 7 is extremely large, resistance received by the air flowing through the air flow passage 8 is extremely small. Thus, by using a propeller fan with a low air blowing pressure as the air blowing means 61, the large quantity of air can be introduced between the helmet 2 and the head part 9 with small electric power.

Subsequently, a relation between the air blowing means 61 and the area of the air inlet 7 will be described. In the first embodiment, as the air blowing means 61, one with light weight and small power consumption or a propeller fan with a diameter of a propeller at 6 cm, for example, is used. Therefore, an effective area of an air intake of the air blowing means 61 is approximately 28 $cm^2$.

Moreover, an area S of the air inlet 7 is obtained from $S=D\times L$ (see FIG. 6(*c*)) by using an interval D between the virtual extension line along the inner edge 24 in the portion of the helmet 2 to which the bag-shaped body 11 is attached and the head part 9 of the user and a lateral width L of the upper end portion of the bag-shaped body 11. In the first embodiment, since the air is taken into the bag-shaped body 11 by the air blowing means 61 and is guided smoothly by the bag-shaped body 11 to the air inlet 7, if the area of the air inlet 7 is at least at the same degree as the effective area of the air intake of the air blowing means 61, the air can be efficiently introduced into the helmet 2. Therefore, if the air blowing means 61 having the propeller with a diameter of approximately 6 cm is used, it is only necessary that the area of the air inlet 7 is at least approximately 28 $cm^2$ and since the interval D is approximately 15 mm in general, it is only necessary that the lateral width L of the upper end portion of the bag-shaped body 11 (first guiding sheet 4) is at least 19 cm.

Subsequently, one example of a method for producing the ventilating device 1 in a helmet will be described.

FIG. 7(*a*) is a schematic front view of the first guiding sheet 4, FIG. 7(*b*) is a schematic front view of the second guiding sheet 5, FIG. 7(*c*) is a schematic rear view of the bag-shaped body 11, and FIG. 7 (*d*) is a schematic front view of the completed ventilating device 1 in a helmet. FIGS. 7(*c*) and 7(*d*) illustrate a state in which the expansion/contraction portion 52 of the bag-shaped body 11 is expanded to the maximum and developed. A dimension of the first guiding sheet 4 and a dimension of the second guiding sheet 5 are indicated in numeral values not including a sewing margin in the following.

First, the first guiding sheet 4 as illustrated in FIG. 7(*a*) and the second guiding sheet 5 as illustrated in FIG. 7(*b*) are produced. Specifically, an outer shape of the first guiding sheet 4 is a substantially trapezoidal shape with an upper side of 30 cm, a lower side of 20 cm, and a height of 17 cm. A portion with a width of 2.5 cm from an end edge of the upper side in the first guiding sheet 4 is the belt attaching portion 41. On a central lower part of the first guiding sheet 4, the opening portion 42 for mounting the air blowing means 61 is formed. Moreover, the outer shape of the second guiding sheet 5 is a shape in which a portion with the width of 2.5 cm corresponding to the belt attaching portion 41 in the first guiding sheet 4 is cut out. That is, the second guiding sheet 5 is formed having a substantially trapezoidal shape with the upper side of 28.5 cm, the lower side of 20 cm, and the height of 14.5 cm. Then, on the upper end portion of this second guiding sheet 5, a strap passing portion 51 through which the rubber strap is passed is formed. Moreover, in the first embodiment, a cloth with moisture permeability is used as a material of the second guiding sheet 5.

Subsequently, the first guiding sheet 4 and the second guiding sheet 5 are overlapped with each other, and the both side end portions thereof are sewn together. After that, both lower end portions of the first guiding sheet 4 and the second guiding sheet 5 are sewn together while a slit 111 for passing a cable through which the cable 62 is put in/out is left. Subsequently, the rubber strap that is a strap-shaped elastic member having a natural length of 15 cm is expanded and passed through the strap passing portion 51 of the second guiding sheet 5, and both end portions of the rubber strap are sewn to end portions of the strap passing portion 51, respectively. By attaching the rubber strap to the strap passing portion 51 as above, the expansion/contraction portion 52 can be easily formed on the upper end portion of the second guiding sheet 5. In this way, the bag-shaped body 11 with the upper part open is obtained by using the first guiding sheet 4 and the second guiding sheet 5. Here, in this bag-shaped body 11, the opening portion 42 for mounting the air blowing means 61 is formed at a predetermined spot of the first guiding sheet 4, while the slit 111 for passing the cable is formed at a predetermined spot on a lower end of the bag-shaped body 11. Moreover, the upper end of the first guiding sheet 4 protrudes upward only by the belt attaching portion 41. The bag-shaped body 11 produced as above is in a state in which the upper end portion of the second guiding sheet 4 is contracted by expandability of the expansion/contraction portion 52 in a natural state, but FIG. 7(*c*) shows the bag-shaped body 11 in which the expansion/contraction portion 52 is expanded and developed.

In the aforementioned method for producing the bag-shaped body 11, in order to simplify the explanation, a length of the upper side of the second guiding sheet 4 is made substantially the same as a length of the corresponding portion of the first guiding sheet 4. However, the length of the upper side of the second guiding sheet 4 (length of the second guiding sheet 5 when the expansion/contraction portion 52 is expanded to the maximum) is preferably shorter than the length of the portion of the first guiding sheet 4 corresponding to the portion of the second guiding sheet 5 where the expansion/contraction portion 52 is formed. When the ventilating device 1 in a helmet of the first embodiment is actually used by being attached to the helmet 2, the upper end portion of the first guiding sheet 4 is in contact with the side peripheral portion of the helmet 2, but the upper end of the second guiding sheet 5 is in contact with the head part. Naturally, since the head part is smaller than the helmet 2, the length of the upper side of the second guiding sheet 5 can be shorter by that difference. By decreasing the length of the upper side of the second guiding sheet 5 properly as above, strength of the rubber strap used for the expansion/contraction portion 52 can be lowered and thus, a sense of discomfort when the expansion/contraction portion 52 is brought into contact with the head part can be eliminated.

Subsequently, the attaching belt 3 is attached to the bag-shaped body 11. As the belt 31 in the attaching belt 3, the one with expandability of a length of 65 cm and a width of 2.5 cm in the natural state is used. The slip stopper 33 is applied to an inner surface side (side in contact with the helmet 2) of this belt 31, and the planar fastener 32 is provided on the both end portions thereof. A surface at a center portion of the attaching belt 3 and to which the slip stopper 33 is not applied is sewn to the belt attaching portion 41 with a width of 2.5 cm in the first guiding sheet 4. After that, the air blowing means 61 is attached to the opening portion 42. Then, a terminal (not shown) provided on one end of the cable 62 is passed into the bag-shaped body 11 through the slit 111 for passing the cable and is connected to the air blowing means 61. Lastly, a terminal provided on the other end of the cable 62 is connected to the power supply 63, whereby production of the ventilating device 1 in a helmet is completed (FIG. 7(*d*)).

As the belt in the attaching belt 3, the one having elasticity does not necessarily have to be used. Particularly if the slip stopper 33 is applied to the belt 31, even if the belt 31 does not have elasticity, this attaching belt 3 functions as attaching means without any problem. Moreover, as the belt 31 of the attaching belt 3, by using transparent plastic having softness such as transparent soft vinyl chloride and by setting a width of the belt attaching portion 41 to approximately 3 mm, a problem relating to loss of notation information which will be described later can be avoided. Moreover, since soft vinyl chloride has large static frictional force to the hat body of the helmet, there is no need to apply separate slip stopper and thus, it is extremely suitable as a material used for the attaching means.

Moreover, for a person with much hair on the back of the head, the hair enters between the surface of the head part and the helmet inner surface, whereby resistance which the air flowing through the helmet receives increases, and as a result, a sufficient ventilation effect cannot be obtained in some cases. However, the problem of this case can be solved by pressing the hair on the back of the head onto the surface of the head part by using a hair band having a proper shape, for example. Moreover, the lateral width of the upper part of the bag-shaped body 11 is preferably equal to such a length that the ears are not covered. That is because, since vibration of the air blowing means 61 is transmitted to the bag-shaped body 11, if the bag-shaped body 11 covers the ears, a vibration noise is directly transmitted to the ears.

As illustrated in FIG. 1(*a*), the notation information 23 such as the name of the person wearing the helmet 2, the name of a company, work contents and the like is usually noted down on the outer surface of the helmet 2, and the notation information 23 is important in safety work and the like. In this embodiment, the width of the belt 31 of the attaching belt 3 is made as small as possible so that the belt 31 does not hide the notation information 23 as much as possible. Specifically, the widths of the belt 31 and the planar fasteners 32 and 32 are set so that a ratio of the attaching belt 3 covering the outer surface of the helmet 2 is 30% of the entire outer surface of the helmet 2 at the most when the attaching belt 3 is attached to the helmet 2. That is, the widths of the belt 31 and the planar fasteners 32 and 32 are preferably approximately 3 cm at the most. Actually, in this embodiment, the widths of the belt 31 and the planar fasteners 32 and 32 are set to 2.5 cm.

In the ventilating device in a helmet of the first embodiment, by including the bag-shaped body with the upper part open, the attaching belt for attaching the bag-shaped body to the helmet, and the air blowing means for taking in the outside air into the bag-shaped body and for sending it out to the side of the open portion of the bag-shaped body, the air having been taken into the bag-shaped body by the air blowing means can be led to the open portion of the bag-shaped body and can be efficiently introduced into the helmet through the air inlet formed between the inner edge of the helmet located close to the open portion and the head part of the user, and thus, sweatiness of the head part of the user can be sufficiently solved by ventilating the inside of the helmet.

Moreover, in the ventilating device in a helmet of the first embodiment, the attaching belt having the belt arranged substantially in parallel with the upper end in the upper end portion of the first guiding sheet and the two planar fasteners provided on the both end portions of the belt is used. Therefore, after the belt is wound along the flange of the helmet around the side peripheral portion thereof, by mutually attaching the two mutually attaching means to each other, the bag-shaped body can be attached to the helmet easily and securely.

Moreover, in the ventilating device in a helmet of the first embodiment, the expandable expansion/contraction portion is formed on the upper end portion of the second guiding sheet, and when the helmet to which the ventilating device in a helmet is attached is worn, the expansion/contraction portion is brought into close contact with the head part excluding the both end portions thereof. As a result, since the large air inlet can be formed between the inner edge of the helmet located close to the expansion/contraction portion and the head part of the user, the air flowing through the bag-shaped body can be smoothly led into the helmet through the large air inlet.

Moreover, in the ventilating device in a helmet of the first embodiment, since the length of the upper end portion of the first guiding sheet is at least 19 cm, the area of the air inlet is large, and the resistance which the air flowing through the air inlet receives is small. Thus, since a propeller fan with a low pressure can be used as the air blowing means, power consumption and the noise of the air blowing means can be both reduced.

Moreover, in the ventilating device in a helmet of the first embodiment, a cloth with moisture permeability is used as the material of the second guiding sheet. If a large quantity of the air is taken into the bag-shaped body from the air blowing means, the bag-shaped body is largely expanded, and then if the second guiding sheet to which no special weight is applied is brought into close contact with the back of the neck part and the back of the head part of the user, by using the cloth with moisture permeability as the second guiding sheet, sweats from the back of the neck part and the back of the head part is emitted into the bag-shaped body through the second guiding sheet, and thus, the back of the neck part and the back of the head part can be also cooled.

In the aforementioned first embodiment, the case in which the bag-shaped body is produced by sewing the first guiding sheet and the second guiding sheet together is described, but the bag-shaped body can be produced by various other methods including a method of sewing one sheet together and the like. In this case, an outer side portion of the bag-shaped body becomes the first guiding sheet, while a side in contact with the head part becomes the second guiding sheet.

Moreover, in the aforementioned first embodiment, the case in which the air blowing means is provided on the lower part of the first guiding sheet is described, but the air blowing means may be provided at a position of the second guiding sheet corresponding to the back of the neck of the user. In this case, since a load of the air blowing means is not applied to the first guiding sheet, the first guiding sheet is easily expanded by an air pressure, whereby an air flow passage is formed. Moreover, since there is a space (gap) between the back of the neck of the user and the position of the second guiding sheet corresponding to that, there is no large hindrance for the air blowing means to take in the air. Moreover, by providing the air blowing means on the second guiding sheet, when the ventilating device in a helmet is used outdoors, rain can be prevented from entering directly the air blowing means. If the air blowing means is provided on the second guiding sheet, a rubber strap with high strength needs to be used so that the expansion/contraction portion do not sag under the weight of the air blowing means 61.

In the ventilating device in a helmet of the first embodiment, since the air blowing means and the cable can be removed easily, the bag-shaped body and the attaching belt can be washed similarly to ordinary clothes.

Second Embodiment

Subsequently, a ventilating device in a helmet that is a second embodiment of the present invention will be described. The ventilating sheet 1*a* in a helmet of the second embodiment is to be used mainly under the blazing sun. FIG. 8(*a*) is a schematic front view of a first guiding sheet used in the ventilating device in a helmet that is the second embodiment of the present invention, FIG. 8(*b*) is a schematic front view of a second guiding sheet used in the ventilating device in a helmet, FIG. 8(*c*) is a schematic rear view of a bag-shaped body in the ventilating device in a helmet, and FIG. 8(*d*) is a schematic front view of the ventilating device in a helmet. Here, FIGS. 8(*a*), 8(*b*), 8(*c*), and 8(*d*) are figures corresponding to FIGS. 7(*a*), 7(*b*), 7(*c*), and 7(*d*) in the first embodiment, respectively. Therefore, FIGS. 8(*c*) and 8(*d*) illustrate a state in which the expansion/contraction portion 52 of a bag-shaped body 11*a* is expanded to the maximum and developed. A dimension of a first guiding sheet 4*a* and a dimension of a second guiding sheet 5*a* are indicated in numeral values not including a sewing margin in the following.

The ventilating device 1*a* in a helmet of the second embodiment includes a bag-shaped body 11*a*, the attaching belt (attaching means) 3, the air blowing means 61, the power supply (power supply means) 63 for driving the air blowing means 61, and the cable 62 for electrically connecting the air blowing means 61 and the power supply 63 as illustrated in FIG. 8(*d*). The bag-shaped body 11*a* is formed having a shape of a bag with an upper part open using two guiding sheets, that is, a first guiding sheet 4*a* and a second guiding sheet 5*a*. The ventilating device 1*a* in a helmet of this second embodiment is different from the ventilating device 1 in a helmet of the first embodiment in that the shape of the bag-shaped body 11*a* is a substantially trapezoidal shape widening as it goes downward, a material used for the first guiding sheet 4*a* is an aluminum sheet obtained by laminating aluminum foil on a nonwoven fabric, and an opening portion for blowing for blowing air to the back of the neck is provided at a portion of the second guiding sheet 5*a* corresponding to the back of the neck, while the others are similar to those in the first embodiment. Therefore, those in the second embodiment having the functions similar to those of the first embodiment are given the same reference numerals or corresponding numerals and detailed description will be omitted. For example, a structure/specification of a portion in contact with the helmet (the attaching means 3, the belt 31, the strap passing portion 51, the belt attaching portion 41 and the like) are similar to those in the first embodiment.

Specifically, the bag-shaped body 11*a* is produced by using the first guiding sheet 4*a* as illustrated in FIG. 8(*a*) and the second guiding sheet 5*a* as illustrated in FIG. 8(*b*). An outer shape of the first guiding sheet 4*a* is a substantially trapezoidal shape with an upper side of 30 cm, a lower side of 35 cm, and a height of 17 cm. A portion with a width of 2.5 cm from an end edge of the upper side in this first guiding sheet 4*a* is the belt attaching portion 41. On a central lower part of the first guiding sheet 4*a*, the opening portion 42 for mounting the air blowing means 61 is formed. In the second embodiment, as the material to be used for the first guiding sheet 4*a*, an aluminum sheet obtained by laminating aluminum foil on a nonwoven fabric is used, as described above. Moreover, the outer shape of the second guiding sheet 5*a* is a shape in which a portion with the width of 2.5 cm corresponding to the belt attaching portion 41 in the first guiding sheet 4 is cut off. That is, the second guiding sheet 5 is formed having a substantially trapezoidal shape with the upper side of 31 cm, the lower side of 35 cm, and the height of 14.5 cm. Then, on the upper end portion of the second guiding sheet 5*a*, the strap passing portion 51 through which the rubber strap is passed is formed. In the second embodiment, at a portion of the second guiding sheet 5*a* corresponding to the back of the neck, an opening portion 54 for blowing for blowing air to the back of the neck is formed. After the first guiding sheet 4*a* and the second guiding sheet 5*a* are overlapped with each other and the respective both side end portions and lower end portions are sewn together, by sewing a rubber strap to the strap passing portion 51 of the second guiding sheet 5*a*, the expansion/contraction portion 52 is formed on the second guiding sheet 5*a*. Thus, the bag-shaped body 11*a* as illustrated in FIG. 8(*c*) is obtained.

In the ventilating device in a helmet of the second embodiment, the bag-shaped body is formed so that it widens more as it goes downward and has a shape that can sufficiently cover the back of the neck of the user, and an aluminum sheet is used as the material used for the first guiding sheet, whereby shining of the sun on the back of the neck can be prevented substantially completely. Moreover, at a portion of the second guiding sheet corresponding to the back of the neck of the user, the opening portion for blowing for blowing a part of the air taken into the bag-shaped body by the air blowing means to the back of the neck of the user is provided. As a result, a part of the air taken into the bag-shaped body by the air blowing means can be blown to the back of the neck of the user through the opening portion for blowing and thus, the back of the neck of the user can be directly cooled. Moreover, the other actions/effects of the ventilating device in a helmet of the second embodiment are the same as those of the first embodiment. In the second embodiment, a mesh member or the like may be provided at the portion of the second guiding sheet corresponding to the back of the neck instead of the opening portion for blowing. Moreover, as a sheet used in the first guiding sheet for shielding the sunlight under the blazing sun, not only an aluminum sheet but a sheet obtained by sputtering titanium on a polyester cloth, for example, can be also used.

OTHER EMBODIMENTS

Incidentally, the present invention is not limited to each of the aforementioned embodiments but is capable of various deformations within the scope of the gist thereof.

In each of the aforementioned embodiments, in the open portion of the bag-shaped body, the case in which the upper end of the first guiding sheet protrudes upward from the upper end of the second guiding sheet is described, but the upper end of the first guiding sheet does not necessarily have to protrude upward from the upper end of the second guiding sheet. That is because, since the bag-shaped body is made of cloth, the large air inlet can be formed between the inner edge of the helmet and the head part of the user in use even if the upper end of the first guiding sheet does not protrude upward from the upper end of the second guiding sheet.

Moreover, in each of the aforementioned embodiments, the case in which the air blowing means is attached to the lower part of the bag-shaped body is described, but the present invention is not limited to that, but the air blowing means may be attached to an upper part or an intermediate part of the bag-shaped body. Particularly if the bag-shaped body having a vertically elongated shape is used, for example, the air blowing means is preferably attached at a center part of the bag-shaped body.

For example, in each of the aforementioned embodiments, the case in which the belt is wound around the side peripheral portion of the helmet by mutually attaching the planar fasteners provided on the both end portions of the belt of the attaching means is described, but any means may be used as long as it is capable of mutual attachment as the attaching means for winding the belt around the side peripheral portion of the helmet. For example, as the attaching means other than the planar fasteners, a button, a string connecting tool or the like sold in the market, for example, can be used.

Moreover, in each of the aforementioned embodiments, as the attaching means, a loop-shaped belt or string having expandability provided on the upper end portion of the first guiding sheet can be used. In this case, the bag-shaped body can be easily attached to the helmet only by attaching the loop-shaped belt or string so as to be fitted into the side peripheral portion of the helmet. Moreover, by attaching one belt or string having expandability to both right and left side portions of the upper end portion of the first guiding sheet, a portion constituted having a loop shape by this belt or string and the upper end portion of the first guiding sheet may be used as the attaching means.

Moreover, in each of the aforementioned embodiments, the length of the belt of the attaching means may be made shorter. In this case, by providing planar fasteners in advance at positions on the side portions of the helmet, these positions facing the planar fasteners provided on the both end portions of the belt, the bag-shaped body can be attached to the helmet by attaching the planar fastener provided on the end portion of the belt to the planar fastener provided on the helmet. As described above, the length of the attaching means does not necessarily have to be a length to encircle the side peripheral portion of the helmet.

Moreover, in each of the aforementioned embodiments, the belt of the attaching means may be produced by a transparent member. As a result, even if the belt overlaps the notation information when the attaching means is attached to the helmet, the others can easily recognize the notation information.

Moreover, in each of the aforementioned embodiments, the case in which, by forming the expandable expansion/contraction portion on the upper end portion of the second guiding sheet, the large air inlet is formed between the inner edge of the helmet located close to the expansion/contraction portion and the head part of the user is described, but the upper end portion of the second guiding sheet does not necessarily have to have the expansion/contraction portion provided. By devising the structure between the upper end portion of the second guiding sheet and the portion of the first guiding sheet corresponding to it so that the interval is kept and an air flow is not hindered or by providing a mesh member having elasticity between the upper end portion of the second guiding sheet and the upper part of the first guiding sheet, for example, the air can be smoothly led into the helmet from the bag-shaped body.

Moreover, in each of the aforementioned embodiments, as the materials of the first guiding sheet and the second guiding sheet used for the bag-shaped body, various materials such as cotton, blended yarn, polyester and the like can be used in accordance with use purposes of the sheet and the like. Particularly, the material of the first guiding sheet does not have to be cloth as long as its air permeability is not so high, and various materials can be used for the first guiding sheet in accordance with the use purpose.

Moreover, in each of the aforementioned embodiments, if time during which the user works by wearing the helmet to which the ventilating device in a helmet of the present invention is attached is short, as the power supply used for the ventilating device in a helmet, a small-sized one with a small capacity may be used. Moreover, this small-sized power supply may also be provided at a predetermined portion of the bag-shaped body.

Moreover, in each of the aforementioned embodiments, the case in which, when the ventilating device in a helmet is attached to the helmet, the head band provided on the helmet is put in between the first guiding sheet and the second guiding sheet is described, but depending on the structure, the shape and the like of the helmet, the head band does not necessarily have to be put in between the first guiding sheet and the second guiding sheet.

Moreover, a target to which the ventilating device in a helmet of the present invention is to be attached is not limited to the work helmet as illustrated in FIG. 1 but the ventilating device in a helmet of the present invention can be attached to any type of helmet as long as it has the similar shape. Moreover, even to the helmet with a shape different from that of the helmet illustrated in FIG. 1, the ventilating device in a helmet of the present invention can be attached by devising the shape of the attaching means and the like. Therefore, the ventilating device in a helmet of the present invention can be used for many helmets. Moreover, the ventilating device in a helmet of the present invention can be also used for some of hats.

Moreover, the opening portion for blowing formed in the aforementioned second embodiment may be formed on the second guiding sheet of the first embodiment, and an aluminum sheet obtained by laminating aluminum foil on a nonwoven fabric may be used as the material used for the first guiding sheet of the first embodiment, and moreover, the shape of the bag-shaped body of the first embodiment may be formed having a substantially trapezoidal shape such that its lateral width widens more as it goes downward similarly to the second embodiment.

INDUSTRIAL APPLICABILITY

As described above, in the ventilating device in a helmet of the present invention, the air having been taken into the bag-shaped body by the air blowing means can be led to the open portion of the bag-shaped body and can be efficiently introduced into the helmet through the air inlet formed between the inner edge of the helmet located close to the open portion and the head part of the user and thus, the inside of the helmet can be ventilated and sweatiness of the head part of the user can be sufficiently solved. Therefore, the ventilating device in a helmet of the present invention is suitable to be used by being attached to the helmet when work is performed by wearing the helmet particularly at a work site or the like.

REFERENCE SIGNS LIST

1, 1*a* ventilating device in a helmet
11, 11*a* bag-shaped body
111 slit for passing cable
2 work helmet
21 flange
22 side peripheral portion
23 notation information
24 inner edge
25 head band
26 hammock
27 chin strap
28 hat body
3 attaching belt (attaching means)
31 belt (elastic belt)
32 planar fastener (mutually attaching means)
33 slip stopper
4, 4*a* first guiding sheet
41 belt attaching portion
42 opening portion
5, 5*a* second guiding sheet
51 strap passing portion
52 expansion/contraction portion
54 opening portion for blowing
61 air blowing means
62 cable
63 power supply (power supply means)
7 air inlet
71 air inlet end portion
8 air flow passage
81 air reservoir
9 head part
S area of air inlet
D interval between inner edge of helmet and head part of user
L lateral width of upper end portion of bag-shaped body

The invention claimed is:

1. An apparatus, comprising:

a helmet with a head band, wherein the head band is provided within an interior of the helmet; and a ventilating device, wherein the ventilating device comprises:

a bag-shaped body composed of a first guiding sheet and a second guiding sheet;

an opening provided at an upper side of the second guiding sheet, wherein an upper end of the first guiding sheet protrudes upward farther than an upper end of the second guiding sheet;

an attaching member provided on an upper portion of the first guiding sheet, wherein the attaching member is directly attached to an outer surface of the helmet;

a fan attached to a predetermined spot of the first guiding sheet, wherein the fan is configured to take in outside air into the bag-shaped body, configured to flow the outside air upwardly along surfaces of the first guiding sheet and the second guiding sheet and between the first guiding sheet and the second guiding sheet, and configured to send the outside air out to the opening of the bag-shaped body; and a power supply, wherein the power supply is configured to drive the fan, wherein the bag-shaped body is attached to the helmet by the attaching member so that the second guiding sheet is located along the interior of the helmet, the first guiding sheet is attached to the outer surface of the helmet via the attaching member, and the head band is located in between the first guiding sheet and the second guiding sheet, wherein the outside air taken into the bag-shaped body by the fan attached to the first guiding sheet is introduced through the opening into the helmet so that the interior of the helmet is ventilated.

2. The apparatus according to claim 1, wherein the attaching member comprises a flexible, transparent plastic belt arranged substantially parallel with the upper end of the first guiding sheet, the attaching member including two complementary fasteners provided on both end portions of the belt.

3. The apparatus according to claim 1, wherein a ratio of the attaching member covering the outer surface of the helmet is 30% of an entirety of the outer surface of the helmet at most.

4. The apparatus according to claim 1, wherein an upper portion of the second guiding sheet includes an expandable expansion/contraction portion.

5. The apparatus according to claim 4, wherein the expansion/contraction portion includes a strap-shaped elastic member incorporated in the upper portion of the second guiding sheet, and a length of the expansion/contraction portion when the expansion/contraction portion is expanded to a maximum is shorter than a length of a portion of the first guiding sheet corresponding to the upper portion of the second guiding sheet within which the expansion/contraction portion is formed.

6. The apparatus according to claim 1, wherein a length of the upper portion of the first guiding sheet is at least 19 cm.

7. The apparatus according to claim 1, wherein the upper portion of the first guiding sheet is separable from an upper portion of the second guiding sheet.

8. The apparatus according to claim 1, wherein the fan is attached to a lower part of the first guiding sheet.

9. The apparatus according to claim 1, wherein the attaching member is a loop-shaped belt or string.

10. The apparatus according to claim 1, wherein the attaching member includes two planar fasteners which are configured to be mutually attachable.

* * * * *